United States Patent [19]

Schroder

[11] Patent Number: 4,824,317

[45] Date of Patent: Apr. 25, 1989

[54] FORK LIFT EXTENSION DEVICE

[76] Inventor: Jurgen R. Schroder, P.O. Box 5]6], Houston, Tex. 77262

[21] Appl. No.: 101,573

[22] Filed: Sep. 28, 1987

[51] Int. Cl.[4] ..... B66F 9/12

[52] U.S. Cl. ..... 414/607; 414/608; 414/785; 414/630; 187/9 R

[58] Field of Search ..... 414/607, 608, 785, 592, 414/630; 187/9 R, 9 E

[56] References Cited

U.S. PATENT DOCUMENTS

| | | | |
|---|---|---|---|
| 2,644,598 | 7/1953 | Winslow . | |
| 3,045,850 | 7/1962 | Carr et al. . | |
| 3,180,512 | 4/1965 | Moss | 414/607 |
| 3,587,893 | 6/1971 | Laken | 414/607 |
| 3,659,732 | 5/1972 | Downey | 414/608 |
| 3,705,658 | 12/1972 | Harris | 414/607 |
| 4,065,013 | 12/1977 | Orthman | 414/607 |
| 4,243,354 | 1/1981 | Garcia | 414/607 |
| 4,290,729 | 9/1981 | Cary | 414/607 |
| 4,403,903 | 9/1983 | Cary | 414/607 |
| 4,497,606 | 2/1985 | Hobson | 414/607 |

FOREIGN PATENT DOCUMENTS

| | | | |
|---|---|---|---|
| 994974 | 11/1951 | France | 414/607 |

*Primary Examiner*—Frank E. Werner
*Attorney, Agent, or Firm*—Vaden, Eickenroht, Thompson & Boulware

[57] ABSTRACT

An extension device for a forklift truck, the truck having extending and movable truck forks, the extension device having a frame with channels therein for receiving the truck forks and one or more extension forks connected to the frame above the channels, with one or more securing arms pivotably connected to the frame for disengagingly contacting the truck.

8 Claims, 4 Drawing Sheets

FORK LIFT EXTENSION DEVICE

FIELD OF THE INVENTION

This invention has to do with extending the reach of a forklift truck of the sort commonly used for moving cargo. Specifically, the invention relates to an attachment, enabling the forklift to handle loads otherwise beyond the upward or forward range of the forks, such as a multi-row array of stacked objects.

DESCRIPTION OF THE PRIOR ART

The typical forklift truck is designed primarily to move a heavy load vertically off the ground, take it to a desired location, and lower it back onto the ground. A logical variation on this theme simply changes that three-step process into a two-step one, in that the cargo can be removed from an elevated position and lowered to the ground somewhat else or taken from the ground to an elevated location somewhere else. In other words, the net displacement of the load need not be purely horizontal, as the typical forklift can move something from the ground onto a shelf (or vice versa). This fact allows for stacking and unstacking objects, a valuable ability regarding the efficient use of space. Still, a forklift can reach no further than its fork and no higher than its lifts, so the vehicle has an inherent limit on the number of vertical and horizontal rows it can access. For example a truck with a 10 foot lift and 5 foot forks simply cannot move a box which sits 11 feet off the ground or 6 feet behind a front row of boxes, no matter how powerful the truck's engine.

In accordance with 37 C.F.R. §1.56, the following references are disclosed:

U.S. Pat. No. 3,045,850 teaches one modification of the standard lifting device, via a hydraulically actuated boom with forks on the far end of the boom.

The method of U.S. Pat. No. 4,013,185 calls for a squeeze lift, whereby the load rides sandwiched between two horizontally spaced members rather than on top of a pair of forks. Squeeze trucking is not suitable for easily deformed cargo such as bananas.

The banana bunch handling truck of Winslow, U.S. Pat. No. 2,644,598, provides for the suspension of the bunches from an elevated extension head.

Other forklift attachments are disclosed in U.S. Pat. Nos. 4,403,903 and 4,290,729. These devices increase the forward and downward reach of a forklift by means of surrogate forks, enabling the truck to reach down into a storage bay, for example. The attachment of U.S. Pat. No. 4,497,606, on the other hand, is a relatively complex machine.

A difficulty with the simple (lightweight) extensions in the prior art is lack of strength, whereas the strongest devices are far from simple. For example, the forks of a typical lift cannot extend indefinitely in length. This is because the applied load would eventually cause the truck to tip, or the blades would deflect excessively. Obviously, the truck can accommodate only so much counterweight, and existing industrial metal compositions can tolerate only so much applied bending moment.

A second difficulty with some of the existing attachments is the act of attaching. An attachment which cannot be removed is really no attachment--it is part of the forklift. Because forklifts need to be able to operate with only the short forks, there is a need for a device which permtis ready connection to and disconnection from the truck.

There has long been a need for a simple, strong extension of the forklift's reach of the forward and vertical directions, without resorting to electric or hydraulic assistance.

SUMMARY OF THE INVENTION

The present invention has both the strength and the lightness required, as well as the needed simplicity of connection. It comprises the union of two triangular subframes into a larger frame, such that each vertex of the first subframe is connected to its counterpart in the second. This nine-membered structure has auxiliary forks extending either from the upper vertex, parallel to the main forks of the truck or disposed on secondary supports at a lower location on the frame.

Bottom frame members have channels for receiving the truck's main forks and each of the truck's main forks goes into one of the channels in the bottom member of the corresponding subframe. In this way, the truck can drive directly into the attachment on the ground. In one embodiment a securing means such as one or more pivoting arms, reaches from the frame to the truck's vertical carriage and pivots to hold and to secure the frame to the truck. Extension forks are provided which can be mounted directly to the frame at a desired location on the frame or which can be mounted to secondary supports which are themselves mounted to the frame.

The present invention, therefore, recognizes, addresses, and satisfies the long-felt need for a simple, strong extension for a forklift.

It is therefore an object of the present invention to provide a unique and efficient forklift extension for a lift truck.

Another object of the present invention is the provision of a support frame for forklift extensions for a lift truck.

Yet another object of the present invention is the provision of a support frame for forklift extensions for a lift truck which is easily connectable to and disconnectable from the lift truck.

A further object of the present invention is the provision of such a support frame having members with channels therein into which the existing forks of a lift truck are easily insertable and from which they are easily removable, yet which maintain the forks in position during operation with the support frame.

An additional object of the present invention is the provision of such a support frame with devices for further securing the frame to a lift truck.

A particular object of the present invention is the provision of such a support frame in which one or more arms pivotably mounted on the support frame are movable to be securingly disposed about a portion of the lift truck thereby holding the support frame on and to the lift truck.

Another object of the present invention is the provision of fork extensions which can be disconnectably mounted to a support frame.

Yet another object of the present invention is the provision of securing members to which fork extensions can be mounted, which securing members are in turn mountable on a support frame to provide extension forks at a desired location on the support frame.

To those of skill in this art who have the benefit of this invention's teachings other and further objects, features and advantages will be clear from the folowing description of the presently preferred embodiments of the invention, given for the propose of disclosure, when taken in conjunction with the accompanying drawings.

DESCRIPTION OF THE PREFERRED EMBODIMENTS

Figure 1:
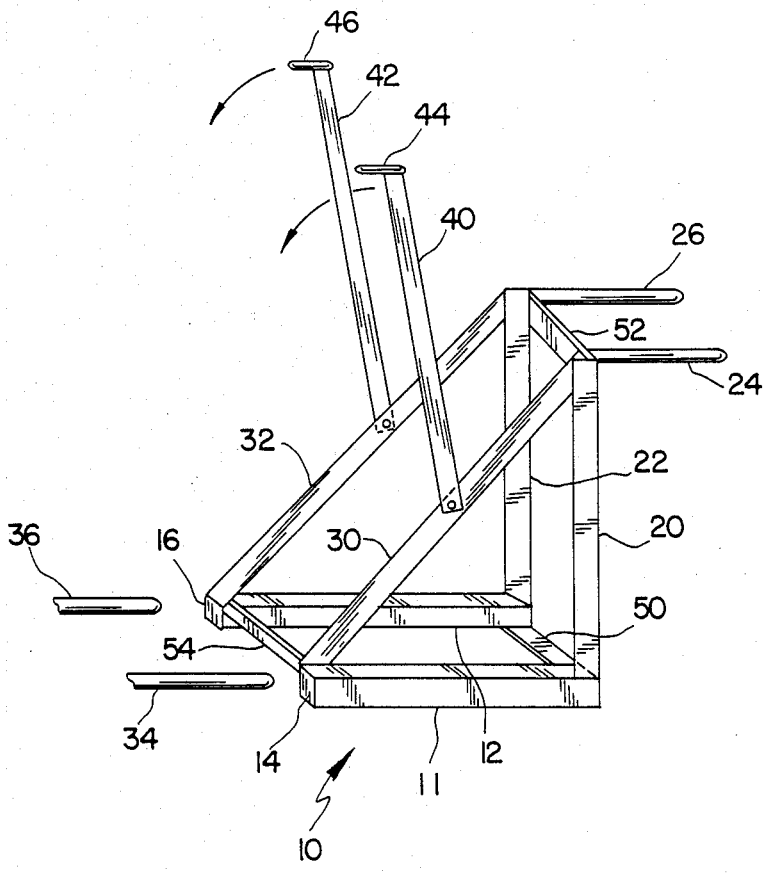
FIG. 1 is a perspective side view of a lift extension according to the present invention.

FIG. 1 shows a perspective side view of a device 10 according to the present invention. Two parallel horizontal members, 11 and 12 are spaced apart and secured together by parallel members 50 and 54. The front end of the member 11 meets the bottom end of a vertical member 20, and the diagonal member 30 completes a right triangle whose sides are the three members 11, 20, and 30. The diagonal member 30 is secured to the top member 20 and to the rear end of member 10.

Likewise, a second triangular subframe comprises the members 12, 22, and 32.

These two subframes are connected to three lateral members, each of which runs from one vertex of the first subframe to the corresponding vertex of the second subframe; so the lateral member 50 connects the 11–20 vertex to the 12–22 vertex; lateral member 52 connects the 20–30 vertex to the 22–32 vertex, and lateral member 54 connects the 30–11 vertex to the 32–12 vertex.

Figure 2:
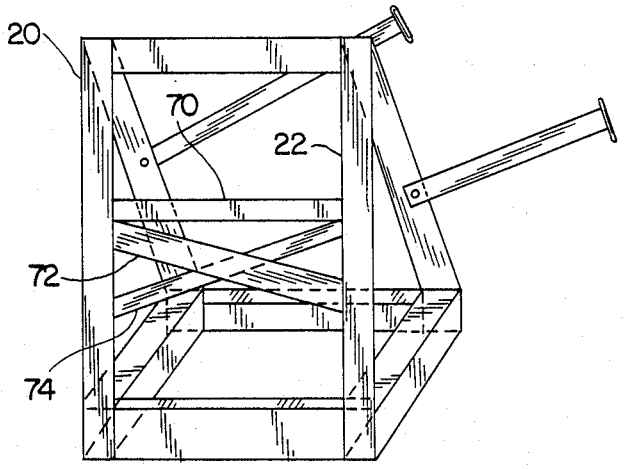
FIG. 2 is a perspective view of the front of the frame of FIG. 1, with additional reinforcement elements at its mid-portion.

FIG. 2 shows the device of FIG. 1 in which the vertical members 20 and 22 have been connected by additional reinforcing elements 70, 72, and 74. The transverse piece 70 serves to give the frame extra stability, while the cross pieces 72 and 74 support against twisting loads. Extension forks 24 and 26 are formed integrally of and extend forward from the horizontally disposed member 52.

Figure 3:
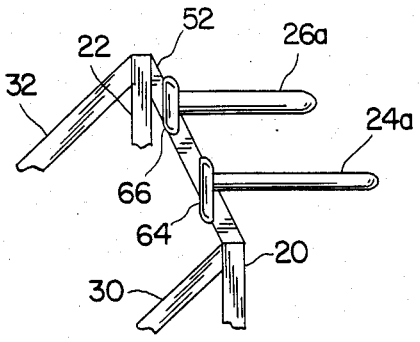
FIG. 3 is a perspective view of the upper frontal region of a frame with fork extensions according to the present invention.

Turning now to FIG. 3, the extension forks **24*a* and 26*a* protrude generally from the upper frontal region of the device, that is, from roughly between the 20–30 and 22–32 vertices, preferably from the lateral member 52. It is especially desirable for the forks 24*a* and 26*a* to be removably mounted on the element 52, by means of holding members 64 and 66**.

Figure 5:
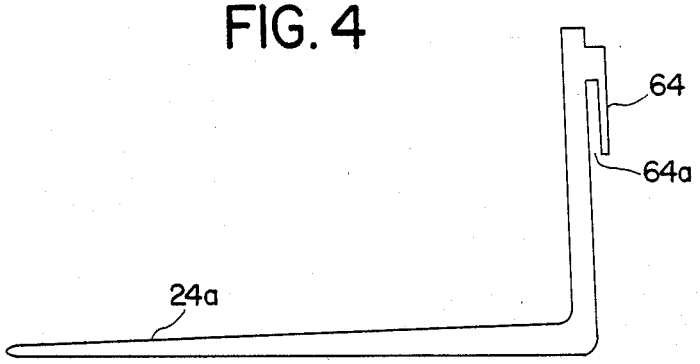
FIGS. 5 and 6 are side views of extension forks according to the present invention.

The extension fork **24*a* has the holding member 64 formed integrally of one of its ends, as shown in FIG. 5. The configuration of the holding member 64 permits disposition of the fork 24*a* on any suitable horizontal member. Of course, extension forks according to the present invention could be secured to the device 10 by any suitable means such as bolts (not shown) or they can be formed integrally of a horizontal member such as the forks 24, 26 of the device of FIG. 1. The recess 64*a* formed within the holding member 64 can be appropriately sized to accommodate horizontal members of different dimensions. The extension fork 26*a* has the same structure as that of fork 24*a***.

Figure 4:
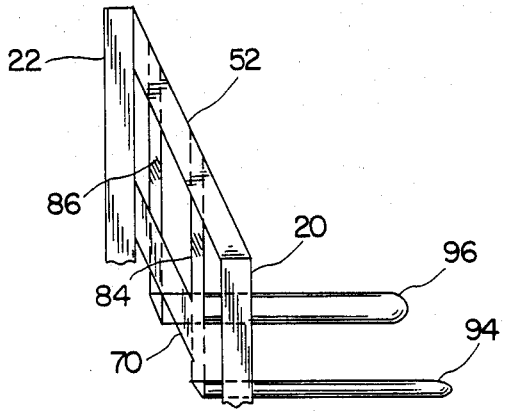
FIG. 4 is a perspective view of the upper frontal region of a frame, showing extension forks with secondary support from a lateral reinforcement element according to the present invention.
Figure 6:
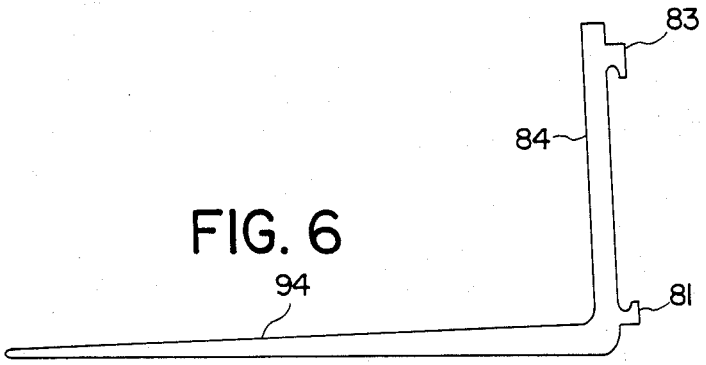

FIG. 4 illustrates another embodiment of the extension forks in which holding members 84, 86 extend downwardly from the lateral element 52. The extension members 84, 86 each have a top holding element 83, 85 (respectively) and a bottom holding element 87, 89 (respectively) which provide connection of the extensions to the frame. The extension forks 94, 96 are formed integrally of and extend from the lower ends of the mid-portions of the holding members 84, 86. The extension member 84 with its extension fork 94 is connected to the horizontal members 52 and 70 with a top holding element 83 and a bottom holding element 81, as shown in FIGS. 4 and 6. The holding elements are sized and fashioned to provide a snap fit about the member 70 after emplacement of the top holding element 83 about the horizontal member 52. The snap action is provided by the configuration of the holding elements and the material from which they are made such as plastic or hard rubber. Alternatively, the lateral elements 52 or 70 (or a portion thereof) can be made from such material to facilitate emplacement of the forks thereon. The extenion member 86 and its fork 96 are similarly configured and disposed.

Figure 7:
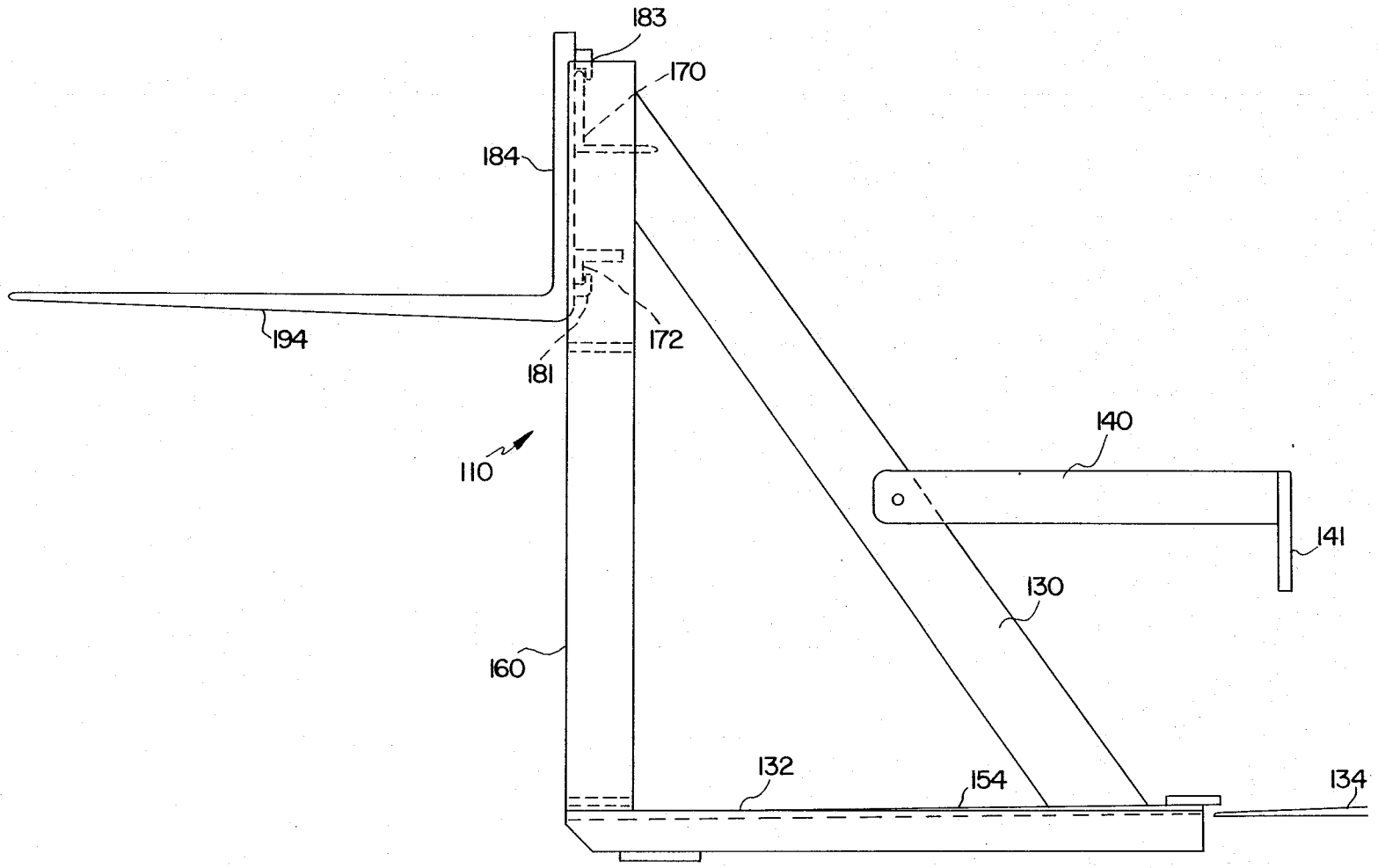
FIG. 7 is a side view of a device according to the present invention.
Figure 8:
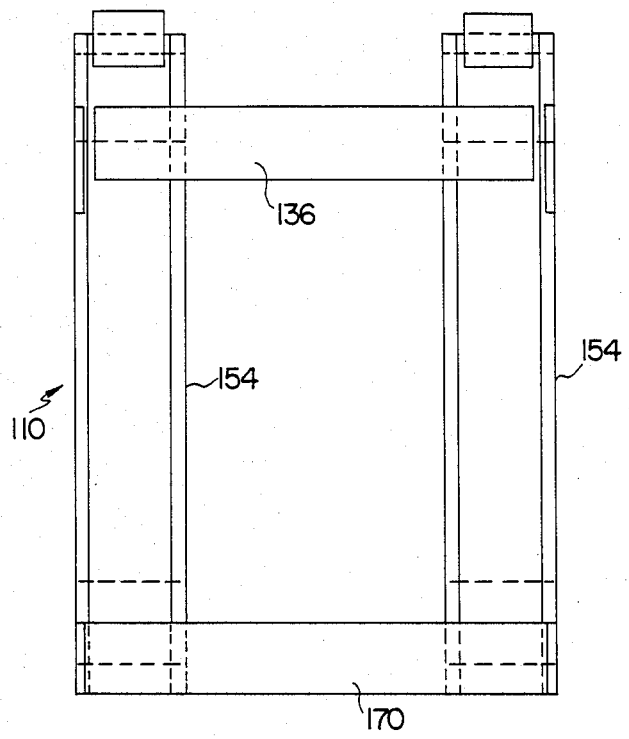
FIG. 8 is a top plan view of the device of FIG. 7.
Figure 9:
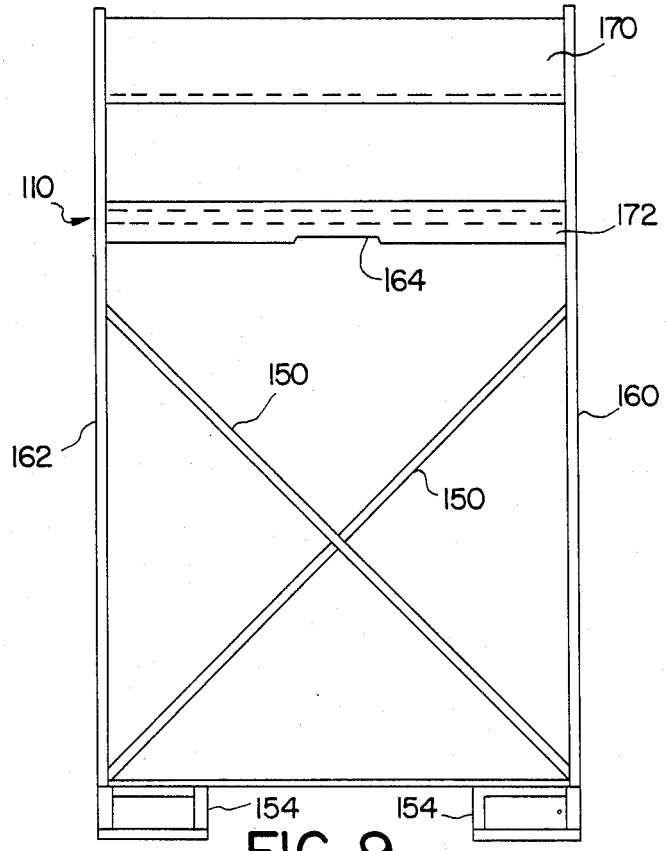
FIG. 9 is an end plan view of the end at the right of the device as shown in FIG. 7.

In the embodiment 110 of a device according to this invention shown in FIGS. 7, 8 and 9, an extension fork 127 (similar to the fork of FIG. 6) has a top holding element 183 and a bottom holding element 181 connected to a midportion member 184. A fork end 194 extends from the member 184 at its bottom. The top holding element 183 engages a top bar 170 which is connected between side members 160 and 162. The bottom holding element 181 engages a bottom bar 172 which is also connected between side members 160 and 162. By providing a notch 164 in the bar 172, the extension forks such as extension fork 127 may be easily emplaced about the bars 170, 172. Of course the notch could be provided in the top bar rather than the bottom bar. This eliminates the need to form part of the fork or the bar out of a material such as plastic or rubber. The embodiment 110 has two forks 127 (as the embodiment 10 has two forks 24 and 26) although only one is shown in FIG. 7.

In the device 110, two arms 140 pivotably mounted to one of two frame members 130 each have a projection 141 which can engage a part of a truck to provide further securement of the device to the truck. Cross braces 150 extending between and secured to the side members 160, 162 provide stability. Hollow channels 154 are configured to receive and hold forks of a typical truck, such as the fork 134. The side member 160 is secured to the frame member 130 and to a channel 154. The frame member 130 is secured to the side member 160 at the top and to a channel 154 at the bottom. A cross frame member 136 is secured between the channels 154.

As shown in FIG. 1, the horizontal members 10 and 12 contain means for receiving and holding the truck forks 34 and 36. This is provided by the hollow channels 14 and 16 in the members 10 and 12 respectively, which are configured to accept the truck forks.

The device 10 transmits loads to a truck not only through the truck's forks 34 and 36, but also through securing means placed above the bottom of the device.

Arms 40 and 42, pivotably mounted on members 30 and 32, respectively provided further securing of the device 10 on a truck. Feet 44 and 46 extend from the non-connected ends of arms 40 and 42, respectively. Placing the arms means higher than the level of the forks 34 and 36 allows for support of greater bending moments, thus lengthening the forward reach of the device. The arms may be moved from a free vertical orientation down to a non-vertical position so that the feet 44 and 46 can reach behind and engage a portion of the truck.

In conclusion, therefore, it is seen that the present invention and the embodiments disclosed herein are well adapted to carry out the objectives and obtain the ends set forth at the outset. To one of skill in this art who has the benefit of this invention's teachings it will be clear that certain changes can be made in the method and apparatus without departing from the spirit and the scope of this invention. The present invention is, therefore, well adapted to carry out the objects and obtain the ends and advantages mentioned, as well as others inherent therein. While there have been described various embodiments of the present invention, the methods and apparatus described are not intended to be understood as limiting the scope of the invention. It is realized that changes therein are possible and it is further intended that each element recited in any of the following claims or any combination of elements is to be understood as referring to all equivalent elements and to all equivalent combinations for accomplishing substantially the same results in substantially the same or equivalent manner. It is intended to cover the invention broadly in whatever form its principles may be utilized.

What is claimed is:

1. An extension device for a forklift truck, the forklift truck having forwardly extending truck fork tines comprising flat elongated members mounted on a truck carriage, the truck carriage movably connected to the truck so that the truck carriage is vertically movable with respect to the truck, the extension device comprising a frame, having a top and a bottom, the frame having a top cross member having a notch area therein for facilitating emplacement of extension fork tines on the top cross member, channels in the bottom of the frame for receiving and holding the truck fork tines, one or more extension fork tines comprising flat elongated members extending from the frame parallel to the truck fork tines at a point above the bottom of the frame, the extension fork tines disconnectably secured to the frame, one or more arms pivotably mounted to the frame for disconnectably engaging a portion of the carriage thereby securing the frame to the carriage, and the extension fork tines having holding elements secured thereto which are emplaceable about the top cross member at the notch area and are then slidable onto an area of the top cross member away from the notch area so that the extension fork tines are held securely about the top cross member.

2. An extension device for a forklift truck, the forklift truck having forwardly extending truck fork tines comprising flat elongated members, mounted on a truck carriage the truck carriage movably connected to the truck so that the truck carriage is vertically movable with respect to the truck, the extension device comprising a frame, having a top and a bottom, channels in the bottom of the frame for receiving and holding the truck fork tines, one or more extension fork tines comprising flat elongated members, extending from the frame and extending further forward then the truck fork tines parallel to the truck fork times at a point above the channels in the bottom of the frame, one or more arms pivotably mounted to the frame, the one or more arms having a downwardly extending projection for disconnectably connecting the frame to a portion of the carriage thereby securing the frame to the carriage.

3. The extension device of claim 2 wherein the extension fork tines are formed integrally of and extend from the frame.

4. The extension device of claim 2 wherein the extension fork tines are separate items disconnectably secured to the frame.

5. The extension device of claim 4 wherein the frame includes a top cross member having a notch area therein for facilitating emplacement of the extension fork tines on the top cross member and wherein the extension fork tines have holding elements secured thereto which are emplaceable about the top cross member at the notch area and are then slidable onto an area of the top cross member away from the notch area so that the extension fork tines are hold securely about the top cross member.

6. The extension device of claim 2 wherein the frame is comprised of two triangular subframes connected at the apexes of the triangular subframes by three parallel horizontally disposed members.

7. An extension device for a forklift truck, the forklift truck having forwardly extending truck fork tines comprising flat elongated members mounted on a truck carriage the truck carriage movably connected to the truck so that the truck carriage is vertically movable with respect to the truck, the extension device comprising a frame having a top and bottom and comprised of two triangular subframes connected to each of the apexes of the triangular subframes by a horizontally disposed member, channels in the bottom of the frame for receiving and holding the truck fork tines, one or more extension fork tines comprising flat elongated members extending from the frame at a point above the channels in the bottom of the frame parallel to the truck fork tines, the extension fork tine or tines being separate members disconnectably secured to the frame and extending further forward then the truck fork tines, and one or more arms pivotably mounted to the frame, the one or more arms having a downwardly extending projection for disconnectably connecting the frame to a portion of the carriage thereby securing the frame to the carriage.

8. An extension device for a forklift truck, the forklift truck having forwardly extending truck fork tines mounted on a truck carriage the truck carriage movably connected to the truck so that the truck carriage is vertically movable with respect to the truck, the extension device comprising a frame, having a top and a bottom, the frame having a top cross member having a notch area therein for facilitating emplacement of extension fork tines on the top cross member, channels in the bottom of the frame for receiving and holding the truck fork tines, one or more extension fork tines comprising flat elongated members extending from the frame parallel to the truck fork tines at a point above the channels in the bottom of the frame, the extension fork tines disconnectably secured to the frame, and extending further forward than the truck fork tines, one or more arms pivotably mounted to the frame, the one or more arms having a downwardly extending projection for disconnectably connecting the frame to a portion of the carriage thereby securing the frame to the carriage, and the extension fork tines having holding elements secured thereto which are emplaceable about the top cross member at the notch area and are then slidable onto an area of the top cross member away from the notch area so that the extension fork tines are held securely about the top cross member.

* * * * *